US005538596A

United States Patent [19]

Satterfield et al.

[11] Patent Number: 5,538,596

[45] Date of Patent: Jul. 23, 1996

[54] PROCESS OF MAKING PAPER

[75] Inventors: Brian F. Satterfield, Columbia, S.C.; John O. Stockwell, West Yorkshire, England

[73] Assignee: Allied Colloids Limited, West Yorkshire, England

[21] Appl. No.: 191,930

[22] Filed: Feb. 4, 1994

[51] Int. Cl.[6] ..... D21H 21/10

[52] U.S. Cl. ..... 162/164.5; 162/164.1; 162/165

[58] Field of Search ..... 162/163, 164.1, 162/164.3, 168.1, 164.5, 165; 210/723, 726, 732, 727

[56] References Cited

U.S. PATENT DOCUMENTS 4,070,236 1/1978 Carrard et al. ..... 162/164.5
4,680,212 7/1987 Blyth et al. ..... 428/97

FOREIGN PATENT DOCUMENTS 0017353 3/1980 European Pat. Off. ..... D21D 3/00

*Primary Examiner*—Peter Chin
*Attorney, Agent, or Firm*—Sughrue, Mion, Zinn, Macpeak & Seas

[57] ABSTRACT

According to the invention, a process of making paper comprises forming a cellulosic suspension, adding retention aid to the suspension, draining the suspension through a screen to form a sheet, and drying the sheet and in this process we add to the suspension a retention system comprising polyethylene oxide and a greater amount (dry weight) of a phenolsulphone-formaldehyde resin (PSR resin) consisting essentially of recurring units of the formula $$-CH_2-X-$$

wherein (a) 10 to 100% of the groups X are di(hydroxyphenyl) sulphone groups, (b) 0 to 90% of the groups X are selected from hydroxy phenyl sulphonic acid groups (i.e., groups which contain at least one hydroxy-substituted phenyl ring and at least one sulphonic group) and naphthalene sulphonic acid groups and (c) 0 to 10% of the groups X are other aromatic groups.

15 Claims, 1 Drawing Sheet

PROCESS OF MAKING PAPER

BACKGROUND OF THE INVENTION

It is standard practice to make paper by a process comprising forming a cellulosic suspension, adding a retention system to the suspension, draining the suspension through a screen to form a sheet, and drying the sheet in conventional manner to make the desired paper, which can be a paper board.

The retention system is included in the suspension before drainage in order to improve retention of fibre and/or filler. The retention system can consist of a single addition of polymer in which event the polymer is usually a synthetic polymer of high molecular weight, or the retention system can comprise sequential addition of different retention aids. Before adding a high molecular weight polymer or other retention aid it is known to include low molecular weight polymer, for instance as a wet strength resin or as a pitch control additive. The molecular weight of such polymers is generally too low to give useful retention.

A common retention system consists of high molecular weight (for instance intrinsic viscosity above 4 dl/g) cationic polymer formed from ethylenically unsaturated monomers including, for instance, 10 to 30 mol % cationic monomer. However retention systems are known in which high molecular weight non-ionic polymer or high molecular weight anionic polymer is used.

In EP-A-017353 we describe a retention system for use in "dirty" pulps (having a high cationic demand) comprising bentonite followed by a substantially non-ionic polymer which can be polyethylene oxide or, for instance, polyacrylamide optionally containing small amounts of anionic or cationic groups. Thus one process comprises adding bentonite to the "dirty" suspension and then adding polyethylene oxide.

Another retention system that is sometimes used for dirty suspensions comprises adding water-soluble phenol formaldehyde resin followed by polyethylene oxide, the amount of phenylformaldehyde resin (on a dry basis) generally being substantially greater than the amount of polyethylene oxide.

Advantages of this system are that the materials are relatively inexpensive and that on some dirty pulps it gives very satisfactory retention at low doses. However it suffers from the disadvantage that it frequently gives rather poor results (even on a dirty suspension having high cationic demand) and the reason for the wide variation in results is not fully understood. Another disadvantage is that the phenol formaldehyde resin tends to become increasingly cross linked with time, with the result that performance may deteriorate upon storage of the resin. Another disadvantage is that the molecular weight of water-soluble phenol formaldehyde resins has to be rather low in order to maintain solubility. Increase in the molecular weight of a retention aid would expected to improve retention, but performance may deteriorate when using phenol formaldehyde resins because of reduced solubility.

It would be desirable to provide a retention system that utilises a different phenolic resin that can easily be manufactured to a higher molecular weight while retaining good solubility in water, and that is storage stable, so as to permit more consistent and/or improved retention, especially in dirty pulps.

Another disadvantage with conventional phenol formaldehyde resins is that they may be less effective in acidic suspensions and it would be desirable to be able to use them satisfactorily in such suspensions.

DETAILED DESCRIPTION OF THE INVENTION

Figure 1:
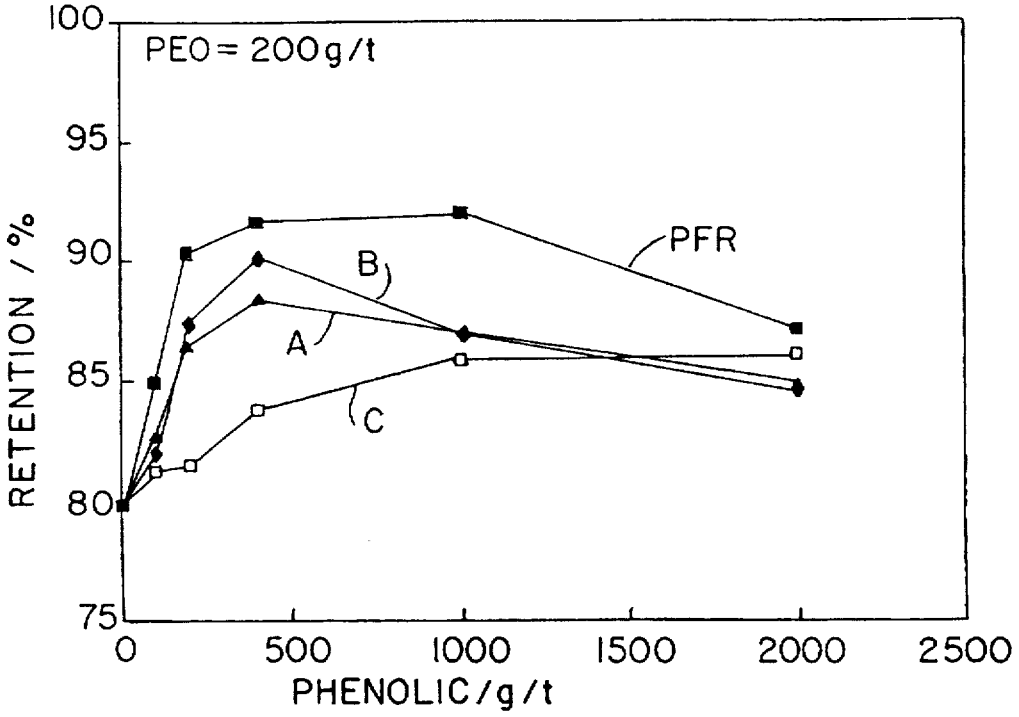
FIG. 1 is a graph showing the results when stock, without pH adjustment, is treated with various amounts of phenolic resin followed by 200 g/t PEO.

According to the invention, a process of making paper comprises forming a cellulosic suspension, adding retention aid to the suspension, draining the suspension through a screen to form a sheet, and drying the sheet and in this process we add to the suspension a retention system comprising polyethylene oxide and a greater amount (dry weight) of a phenolsulphone-formaldehyde resin (PSR resin) consisting essentially of recurring units of the formula $$—CH_2—X—$$

wherein (a) 10 to 100% of the groups X are di(hydroxyphenyl) sulphone groups, (b) 0 to 90% of the groups X are selected from hydroxy phenyl sulphonic acid groups (i.e., groups which contain at least one hydroxy-substituted phenyl ring and at least one sulphonic group) and naphthalene sulphonic acid groups and (c) 0 to 10% of the groups X are other aromatic groups.

The amount of groups (a) is usually at least 40%, and preferably at least 65%. It can be 100%, but is often not more than about 95%, with amounts of 70 to 75% to 95% often being preferred.

The amount of groups (b) can be zero, but it is usually desirable to include at least about 5% in order to improve the solubility of the resin. It is usually not more than 60%, although higher amounts can be used especially when the groups (b) are also groups (a). The amount of groups (b) is often in the range 5 to 35%, preferably 5 to 25%.

Groups (c) do not usually contribute usefully to the performance of the PSR and so the amount of them is usually low, often zero.

Although all the groups (b) can be naphthalene sulphonic acid groups, usually at least half, and preferably all the groups (b) are hydroxy-phenyl sulphonic acid groups. Any groups (c) are usually hydroxy-phenyl groups, most usually phenol or a substituted phenol.

When some or all of groups (b) are di(hydroxy-phenyl) sulphone groups which are substituted by sulphonic acid, these groups will count also as groups (a). Preferably at least half the groups (a), and usually at least three quarters and most preferably all the groups (a), are free of sulphonic acid groups.

The preferred PSR resins include 40 to 95% (usually 50 to 95% and most preferably 70 or 75% to 90 or 95%) di(hydroxy-phenyl) sulphone groups free of sulphonic acid groups and 5 to 60% (usually 5 or 10% to 25 or 30%) hydroxy-phenyl sulphonic acid groups free of di(hydroxyphenyl) sulphone groups and 0 to 10% other hydroxylphenyl groups.

The methylene linking groups in the PSR resins are usually ortho to a phenolic hydroxyl group and suitable PSR resins can be represented as having the following recurring groups.

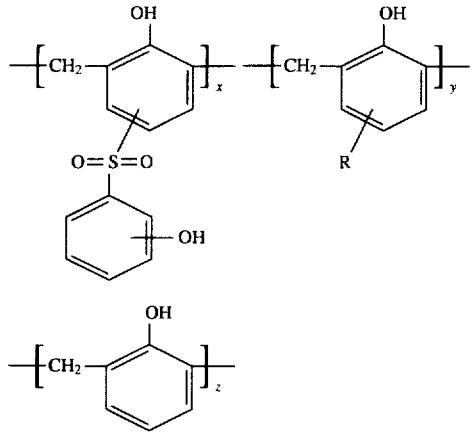

where

R is $SO_3H$ or

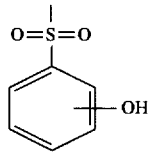

and x is 0.1 to 1.0 preferably 0.5 to 0.95, especially 0.7 to 0.9, y is 0 to 0.9 preferably 0.05 to 0.6, especially 0.05 to 0.3, z is 0 to 0.1 and x+y+z=1 except that preferably some or all of the sulphone groups have one methylene linkage onto one of the phenyl rings and the other methylene linkage onto the other ring. The various rings may be optionally substituted and usually have the sulphone group and the group R para to the phenolic hydroxyl group, as discussed below.

Increasing the total amount of sulphone groups (that contain 2 phenyl rings) relative to the amount of groups that contain a single phenyl ring can increase the molecular weight that is attainable without insolubilisation due to cross linking since it increases the tendency for the methylene links to be on different phenyl groups. Increasing the amount of sulpnonic acid substituted groups tends to increase the solubility of the compound, but if the proportion is too high (and especially if the sulphonic compound is naphthalene sulphonic acid or a monocyclic sulphonic acid) may depress molecular weight.

The compounds wherein 5 to 25%, preferably 5 to 20%, of the groups contain sulphonic acid groups are novel compounds and form a further aspect of the invention. Preferred novel compounds have the formula shown above wherein x is 0.75 to 0.95, y is 0.05 to 0.25 (preferably 0.05 to 0.2), z is 0 to 0.1 (preferably 0) and R is $SO_3H$. These novel compounds are useful as retention aids in the manufacture of paper (especially in the process of the invention) and as carpet stain blockers (see for instance U.S. Pat. No. 4,680,212). The characteristic content of sulphonic groups permits the compounds to be made easily to a particularly suitable combination of high molecular weight and solubility. The molecular weight of the new compounds is preferably such that they have the solution viscosity mentioned below.

The sulphonic acid groups may be in the form of free acid or water soluble (usually alkali metal) salt or blend thereof, depending on the desired solubility and the conditions of use.

The PSR resin may be made by condensing 1 mole of the selected phenolic material or blend of materials with formaldehyde in the presence of an alkaline catalyst. The amount of formaldehyde should normally be at least 0.7 moles, generally at least 0.8 and most preferably at least 0.9 moles. The speed of the reaction increases, and the control of the reaction becomes more difficult, as the amount of formaldehyde increases and so generally it is desirable that the amount of formaldehyde should not be significantly above stoichiometric. For instance generally it is not more than 1.2 moles and preferably not more than 1.1 moles. Best results are generally obtained with around 0.9 to 1 mole, preferably about 0.95 moles formaldehyde.

The phenolic material that is used generally consists of (A) a di(hydroxyphenyl)sulphone, (B) a sulphonic acid selected from phenol sulphonic acids and sulphonated di(hydroxyphenyl)sulphones (and sometimes naphthalene sulphonic acid) and (C) 0 to 10% of a phenol other than a or b, wherein the weight ratio a:b is selected to give the desired ratio of groups (a):(b). Usually the ratio is in the range 25:1 to 1:10 although it is also possible to form the condensate solely from the sulphone (a), optionally with 0–10% by weight (c). Generally the ratio is in the range 20:1 to 1:1.5 and best results are generally obtained when it is in the range 20:1 to 1:1, often 10:1 to 2:1 or 3:1.

Component (A) is free of sulphonic acid groups. It is generally preferred that at least 50% by weight of component B is free of di(hydroxyphenyl)sulphone groups and preferably all of component B is provided by a phenol sulphonic acid.

Other phenolic material (C) can be included but is generally omitted.

The preferred PSR resins are made by condensing formaldehyde (generally in an amount of around 0.9 to 1 mole) with 1 mole of a blend formed of 95 to 40 parts by weight (preferably 95 to 80 or 75 parts by weight) di(hydroxyphenyl)sulphone that is free of sulphonic acid groups with 5 to 60 (preferably 5 to 25 or 30) parts by weight of a phenol sulphonic acid.

The di(hydroxy-phenyl)sulphone is generally a symmetrical compound in which each phenyl ring is substituted by hydroxy at a position para to the sulphone group, but other compounds of this type that can be used include those wherein either or both of the hydroxy groups is at an ortho or meta position to the sulphone group and those wherein there are non-interfering substituents elsewhere in the ring.

The hydroxyphenyl sulphonic acid generally has the hydroxyl group of the phenyl in a position para to the sulphonic acid group, but other compounds of this type that can be used include those wherein the sulphonic acid group is ortho or meta to the hydroxyl group and those wherein there are other non-interfering substituents elsewhere in the ring.

Other phenyls that can be included are unsubstituted phenyls and phenyl substituted by non-interfering groups.

Typical non-interfering groups may be included in any of the phenyl rings include, for instance, alkyl groups such as methyl.

The molecular weight of the condensate is preferably such that a 40% aqueous solution of the full sodium salt of the condensate has a solution viscosity of at least 50 cps, generally at least 200 cps and typically up to 1000 cps or more, when measured by a Brookfield viscometer using spindle 1 at 20 rpm and 20° C.

Suitable PSR resins having a content of phenol sulphonic acid of above 25% are available from Allied Colloids Limited under the tradenames Alcofix SX and Alguard NS.

The polyethylene oxide preferably has molecular weight of at least about 1 million, and most preferably about 1.5 or 2 million, for instance up to 5 million or more. The PSR is preferably incorporated first into the suspension, for instance by mixing a solution of the PSR into the suspension. This allows the PSR to adsorb onto the fibres of the suspension. The polyethylene oxide is then added to the suspension as a solution, whereupon visible flocculation occurs. We believe this flocculation is probably due to hydrogen bonding interaction between the PSR and the polyethylene oxide.

The ratio by dry weight of the PSR to the polyethylene oxide is usually at least 1:1 and is preferably at least 1.5:1. Although it may be as high as, for instance, 6:1 it is generally unnecessary for it to be above about 3:1.

The two retention aids can be added to the suspension simultaneously or, preferably, sequentially. Best results are generally obtained when the PSR is added first and, after it is thoroughly distributed through the suspension and after it is absorbed onto the fibres, the PEO is added.

Although useful retention can be obtained using the PSR in combinations with relatively low amounts of PEO, such as 50 g/ton (grams dry weight PEO per ton dry weight suspension) the invention is of particular importance when the overall dosage is being made with a view to obtaining the highest possible retention value. In general, the retention value increases as the amount of polyethylene oxide increases and so the advantage of using a PSR is particularly significant at higher dosages of polyethylene oxide, for instance at least 100 or 200 g/t and generally at least 300 or 400 g/t. The amount of polyethylene oxide is generally below 2,000, and preferably below 1,500 g/t. Best results in the invention are obtained using 200 to 1,000, preferably 300 or 400 to 1,000, g/t and the PSR in an amount of 1.5 to 3 times the amount of polyethylene oxide, the PSR preferably having been absorbed onto the cellulosic fibres before the addition of polyethylene oxide.

The use of the combined retention system is of particular value when the suspension is relatively dirty and contains lignins and anionic trash. The dirty suspension can be dirty due to the inclusion of a significant amount, for instance at least 25% and usually at least 50% dry weight, of a dirty pulp such as a pulp selected from ground wood, thermomechanical pulp, de-inked pulp, and recycled pulp. Many paper mills now operate on a partially or wholly closed system with extensive recycling of white water, in which event the suspension may be relatively dirty even though it is made wholly or mainly from clean pulps such as unbleached/or bleached hardwood or softwood pulps, and the invention is of value in these closed mills.

In general the invention is of value wherever the suspension, in the absence of the retention system, has a cationic demand of at least 0.05 meq/l, usually at least 0.1 and most usually at least 0.03 meq/l and up to, for instance 0.6 meq/l. In this specification cationic demand is the amount of polydiallyl dimethyl ammonium chloride homopolymer (POLYDADMAC) having intrinsic viscosity about 1 dl/g that has to be titrated into the suspension to obtain a point of zero charge when measuring streaming current potential using Mutek PCD 02 instrument.

The suspension may be substantially unfilled, for instance containing not more than about 5% or 10% by weight (based on the dry weight of the suspension) filler. Some or all of the filler may be introduced as a result of some or all of the suspension being derived from de-inked pulp or broke, or may be filled as a result of the deliberate addition of inorganic filler typically in amounts of from 10 to 60% by weight.

The invention is of particular value in suspensions that are unfilled or only contain a small amount of filler and in the production of paper that is substantially unfilled or only contains a small amount of filler. For instance the invention is preferably used in processes for making paper containing not more than 15% and generally not more than 10% by weight filler or which is unfilled. In particular the invention is of value in the manufacture of paper of speciality ground woods and in the manufacture of newsprint.

The suspension may, before addition of the retention aids, have had conventional additives included in it such as bentonite, cationic starch, low molecular weight cationic polymers and other polymers for use as, for instance, dry or wet strength resins.

Although the invention is of particular value when the suspension is dirty, it can also be used in clean suspensions, for instance made from unbleached and/or bleached hardwood or softwood pulps and having low cationic demand (below 0.1 and usually below 0.05 meq/l) provided the suspension has a pH such that the PSR has appropriate solubility in that suspension. It may be desirable to select the proportion of sulphonic groups having regard to the pH of the suspension so as to obtain a level of solubility that gives optimum performance. It appears to be desirable that the solubility should not be too high and preferably the PSR and PEO, when mixed as aqueous solutions in the desired proportions at the pH of the suspension, form a somewhat gelatinous rheology.

The invention is of particular value in acidic suspensions, for instance pH4 to 6 or higher and especially 4.2 to 5.5, since reducing the pH can improve performance whereas it normally worsens performance when using conventional phenol formaldehyde instead of the PSR.

In the following examples of the invention, 500 ml of a groundwood stock was stirred at 1000 rpm in a Britt jar, the first retention aid was added as a solution and the suspension stirred for 30 seconds and the second component was then added as a solution and stirred for 30 seconds. 100 ml of the treated suspension was then filtered through a 75 μm filter. The first 30 ml was discarded and the solids content of the remainder was recorded and utilised to express % retention.

PFR is a conventional phenol formaldehyde retention resin (Cascophen PR511)

A is a PSR formed from formaldehyde with p- di (hydroxyl phenyl) sulphone and p-phenol sulphonic acid in a weight ratio of 50:50

B is a PSR formed from the same materials but with a weight ratio of 70:30

PEO is Equip polyethylene oxide

C is Mimosa tannin

In each of these examples, the phenolic was used as the first component and the PEO as the second.

EXAMPLE 1

When testing the retention of 1% groundwood stock using PEO with phenol formaldehyde resin and product A, with the stock at different pH values, the % retention values obtained were:

| polymer / g/t | pH 7.1 | pH 4.5 |
|---|---|---|
| blank | 75.2 | 78.4 |
| PFR + PEO | | |
| 400 + 200 | 92.9 | 87.3 |
| 800 + 400 | 95.9 | 95.3 |

-continued

| polymer / g/t | pH 7.1 | pH 4.5 |
|---|---|---|
| A + PEO | | |
| 400 + 200 | 89.3 | 92.1 |
| 800 + 400 | 93.6 | 96.7 |

This shows the benefit of PSR at low pH values.

EXAMPLE 2

When the stock, without pH adjustment, is treated with various amounts of phenolic resin followed by 200 g/t PEO the results shown in FIG. 1 were obtained.

EXAMPLE 3

Figure 2:
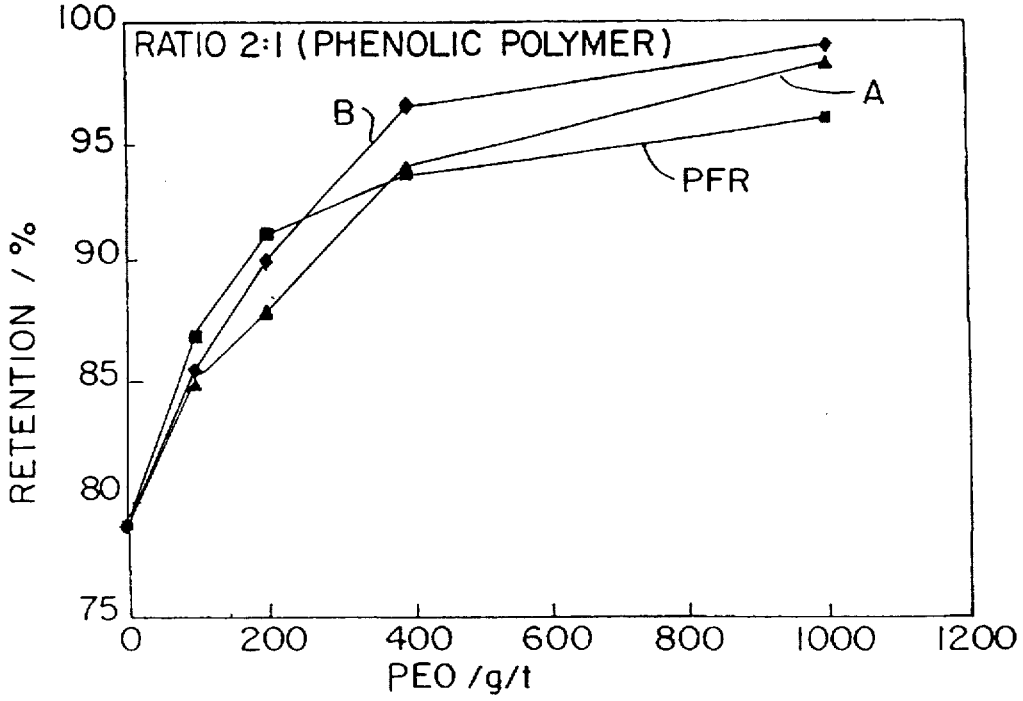
FIG. 2 is a graph showing the results when stock, without pH adjustment, is treated with various amounts of retention aid but at a fixed ratio of 2 phenolic:1 PEO.

When the stock, without pH adjustment is treated with various amounts of retention aid but at a fixed ratio of 2 phenolic:1 PEO, the results shown in FIG. 2 were obtained.

This shows the benefit of PSR, especially when the amount of the sulphonic acid groups is less than 50%.

I claim:

1. A process of making paper comprising forming a cellulosic suspension, adding retention aid to the suspension, draining the suspension through a screen to form a sheet, and drying the sheet and in which process there is added to the suspension a retention system comprising polyethylene oxide and a phenolsulfone-formaldehyde resin (PSR resin) consisting essentially of recurring units of the formula $$—CH_2—X—$$

wherein (a) 70 to 100% of the groups X are di(hydroxyphenyl) sulfone groups, (b) 0 to 30% of the groups X are selected from hydroxy phenyl sulfonic acid groups and naphthalene sulfonic acid groups and (c) 0 to 10% of the groups X are other aromatic groups and wherein the dry weight ratio of PSR resin:polyethylene oxide is at least 1:1 and the amount of polyethylene oxide is at least 50 g/t.

2. A process according to claim 1 in which the amount of groups (a) is in the range 75% to 95% and the amount of group (b) is in the range of 5% to 25%.

3. A process of making paper comprising forming a cellulosic suspension, adding retention aid to the suspension, draining the suspension through a screen to form a sheet, and drying the sheet and in which process there is added to the suspension a retention system comprising polyethylene oxide and a phenolsulfone-formaldehyde resin (PSR resin) which is a condensate of formaldehyde with a blend of 75% to 95% by weight of di(hydroxyphenyl) sulfone that is free of sulfonic groups with 5% to 25% by weight of a phenol sulfonic acid, wherein the dry weight ratio of PSR resin:polyethylene oxide is at least 1:1 and the amount of polyethylene oxide is at least 50 g/t.

4. A process according to claim 1 in which the PSR resin has a solution viscosity of at least 200 cps when measured by a Brookfield viscometer using spindle 1 at 20 rpm and 20° C. on a 40% aqueous solution of a full sodium salt of said PSR resin.

5. A process according to claim 1 in which the PSR resin and the polyethylene oxide are added sequentially and in which the PSR resin is added before the polyethylene oxide is added.

6. A process according to claim 1 in which the suspension has a cationic demand in the range 0.03 meq/l to 0.6 meq/l.

7. A process according to claim 1 in which the suspension is formed from at least 50% dry weight of pulp selected from the group consisting of groundwood, thermomechanical pulp and recycled pulp.

8. A process according to claim 1 in which the ratio PSR resin:polyethylene oxide is from 1:1 to 3:1.

9. A process according to claim 3 in which the PSR resin has a solution viscosity of at least 200 cps when measured by a Brookfield viscometer using spindle 1 at 20 rpm and 20° C. on a 40% aqueous solution of a full sodium salt of said PSR resin.

10. A process according to claim 3 in which the PSR resin and the polyethylene oxide are added sequentially and in which the PSR resin is added before the polyethylene oxide is added.

11. A process according to claim 3 in which the suspension has a cationic demand in the range 0.03 meq/l to 0.6 meq/l.

12. A process according to claim 3 in which the suspension is formed from at least 50% dry weight of pulp selected from the group consisting of groundwood, thermomechanical pulp and recycled pulp.

13. A process according to claim 3 in which the ratio PSR:polyethylene oxide is from 1:1 to 3:1.

14. A process according to claim 8, in which the recycled pulp is deinked pulp.

15. A process according to claim 13 in which the recycled pulp is deinked pulp.

* * * * *